US009416943B2

(12) United States Patent
Dai et al.

(10) Patent No.: US 9,416,943 B2
(45) Date of Patent: Aug. 16, 2016

(54) LIGHT-EMITTING DEVICE AND BACKLIGHT MODULE HAVING THE LIGHT-EMITTING DEVICE THEREIN

(71) Applicant: HON HAI PRECISION INDUSTRY CO., LTD., New Taipei (TW)

(72) Inventors: Feng-Yuen Dai, Tu-Cheng (TW); Chau-Jin Hu, Tu-Cheng (TW); Li-Ying Wang He, Tu-Cheng (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 110 days.

(21) Appl. No.: 14/520,576

(22) Filed: Oct. 22, 2014

(65) Prior Publication Data

US 2015/0138757 A1 May 21, 2015

(30) Foreign Application Priority Data

Nov. 18, 2013 (TW) ..... 102141835 A

(51) Int. Cl.

| | |
|---|---|
| ***G09F 13/04*** | (2006.01) |
| ***G09F 13/08*** | (2006.01) |
| ***F21V 13/04*** | (2006.01) |
| ***F21V 7/04*** | (2006.01) |
| *F21V 5/04* | (2006.01) |
| *F21Y 101/02* | (2006.01) |

(52) U.S. Cl.

CPC . *F21V 13/04* (2013.01); *F21V 5/04* (2013.01); *F21V 5/048* (2013.01); *F21V 7/043* (2013.01); *F21V 5/043* (2013.01); *F21Y 2101/02* (2013.01)

(58) Field of Classification Search

CPC .. F21V 5/00; F21V 5/002–5/008; F21V 5/02; F21V 5/04; F21V 5/041; F21V 5/043; F21V 5/045–5/046; F21V 5/048; F21V 5/06; F21V 5/08; F21V 13/06; F21V 13/14; G02B 19/0009; G02B 19/0014; G02B 19/0028

USPC ..... 362/97.1–97.4, 255–257, 280, 310, 362/296.05, 311.01–311.02, 311.06, 326, 362/331, 336, 355

See application file for complete search history.

(56) References Cited

U.S. PATENT DOCUMENTS

| | | | | |
|---|---|---|---|---|
| 2006/0023452 | A1* | 2/2006 | Lai | F21V 7/0008 362/253 |
| 2013/0343061 | A1* | 12/2013 | Liao | G02B 6/0035 362/296.01 |
| 2014/0218916 | A1* | 8/2014 | Chen | F21V 5/007 362/235 |
| 2015/0145406 | A1* | 5/2015 | Li | F21V 3/0481 313/502 |
| 2015/0274320 | A1* | 10/2015 | Jha | F21V 13/06 362/470 |

* cited by examiner

*Primary Examiner* — Anne Hines
*Assistant Examiner* — Jose M Diaz
(74) *Attorney, Agent, or Firm* — ScienBiziP, P.C.

(57) ABSTRACT

A light-emitting device includes a base and a light source and a diverging unit placed on the base. The diverging unit has a divergent lens and a diverging ring. The divergent lens includes a light incident surface, a light exiting surface, and a side surface. The side surface is connected to the light incident surface and the light exiting surface. The divergent lens defines a receiving space and the receiving space extending into the divergent lens from the light incident surface towards the light exiting surface. The light source is received in the receiving space. The diverging ring is positioned on the light exiting surface and in-line with the light source so that the diverging ring reflects light from the light source transmitted through the divergent lens in multiple directions.

18 Claims, 6 Drawing Sheets

LIGHT-EMITTING DEVICE AND BACKLIGHT MODULE HAVING THE LIGHT-EMITTING DEVICE THEREIN

FIELD

The subject matter herein generally relates to a light-emitting device and a backlighting having the light emitting device therein.

BACKGROUND

Large scale displays are constructed with direct-type backlight module. The direct-type backlight modules are built with light emitting diodes (LEDs) and their lens. The luminance is distributed from the center outwards and the light escaping outwards should be even in quality. FIG. 1 illustrates a luminance simulation diagram of a current LED of a prior art. The luminance is unequally distributed from the center toward the surrounding that results in uneven lights existing from the direct-type backlight module and bad display quality.

BRIEF DESCRIPTION OF THE DRAWINGS

Implementations of the present technology will now be described, by way of example only, with reference to the attached figures.

DETAILED DESCRIPTION

Figure 1:
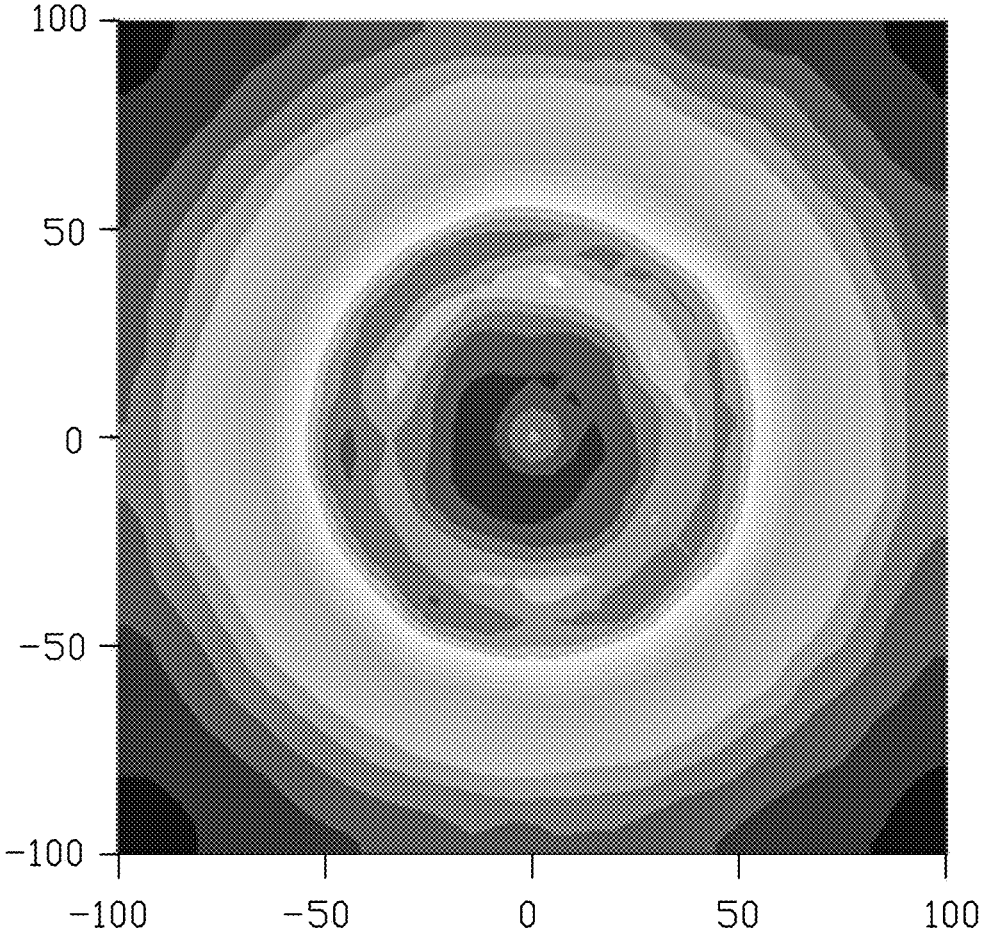
FIG. 1 illustrates a luminance simulation diagram of a current LED of a prior art.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "substantially" is defined to be essentially conforming to the particular dimension, shape, or other feature that the term modifies, such that the component need not be exact. For example, "substantially cylindrical" means that the object resembles a cylinder, but can have one or more deviations from a true cylinder. The term "comprising," when utilized, means "including, but not necessarily limited to"; it specifically indicates open-ended inclusion or membership in the so-described combination, group, series and the like.

The present disclosure is described in relation to a light-emitting device and a backlight module comprising the light-emitting devices.

Figure 2:
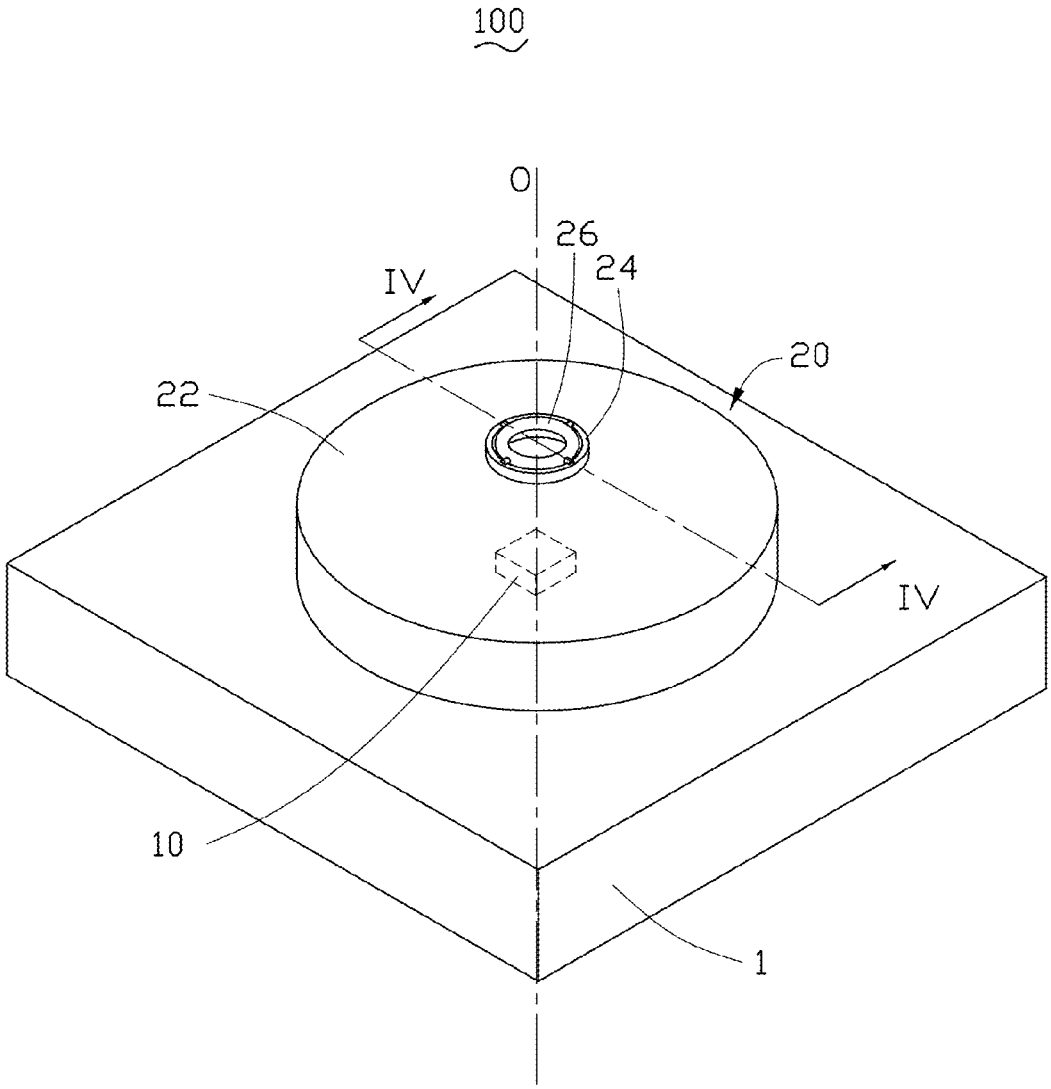
FIG. 2 is an isometric view of a light-emitting device of an embodiment of the disclosure.
Figure 3:
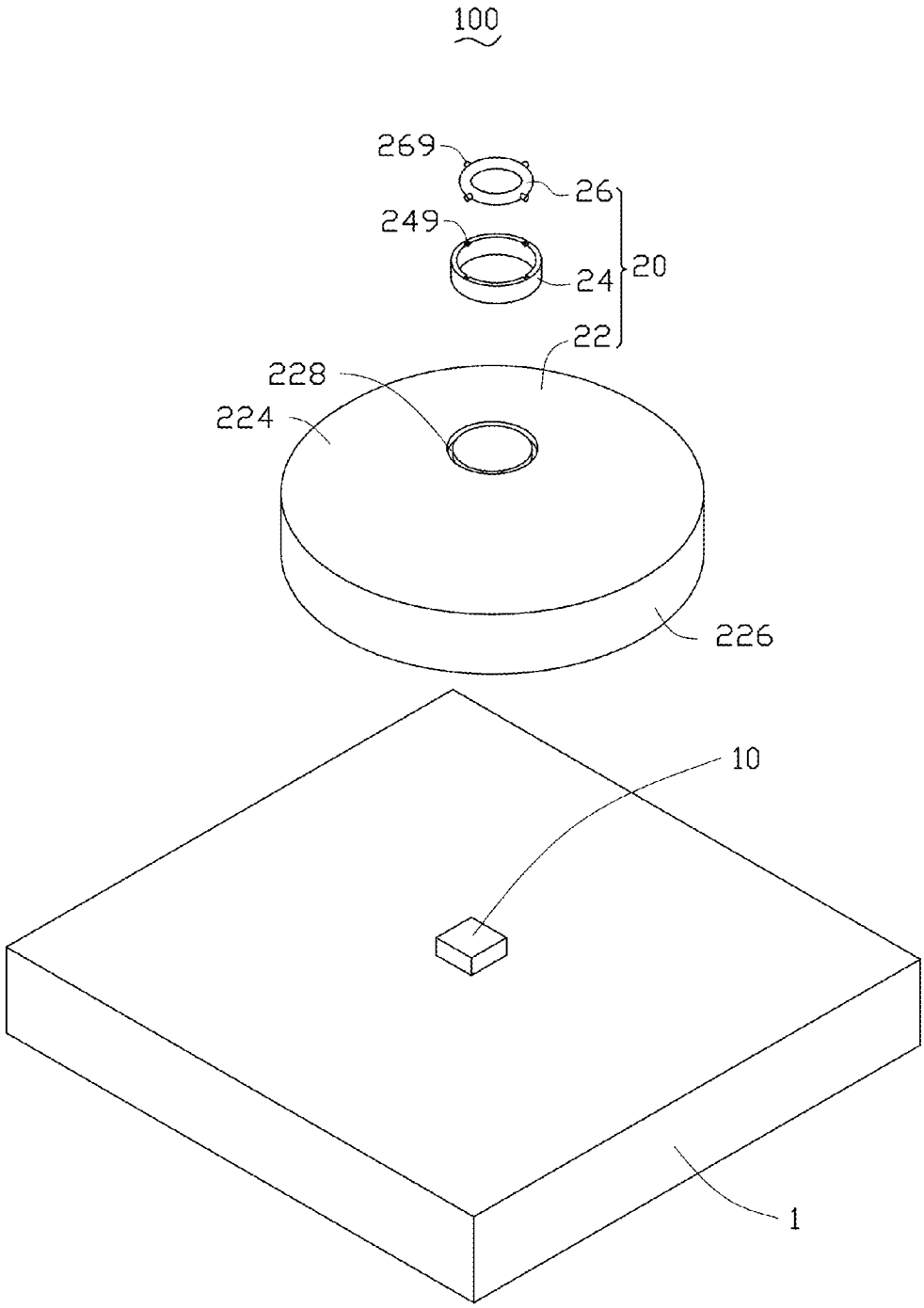
FIG. 3 is an exploded, isometric view of the light-emitting device illustrated in FIG. 2.
Figure 4:
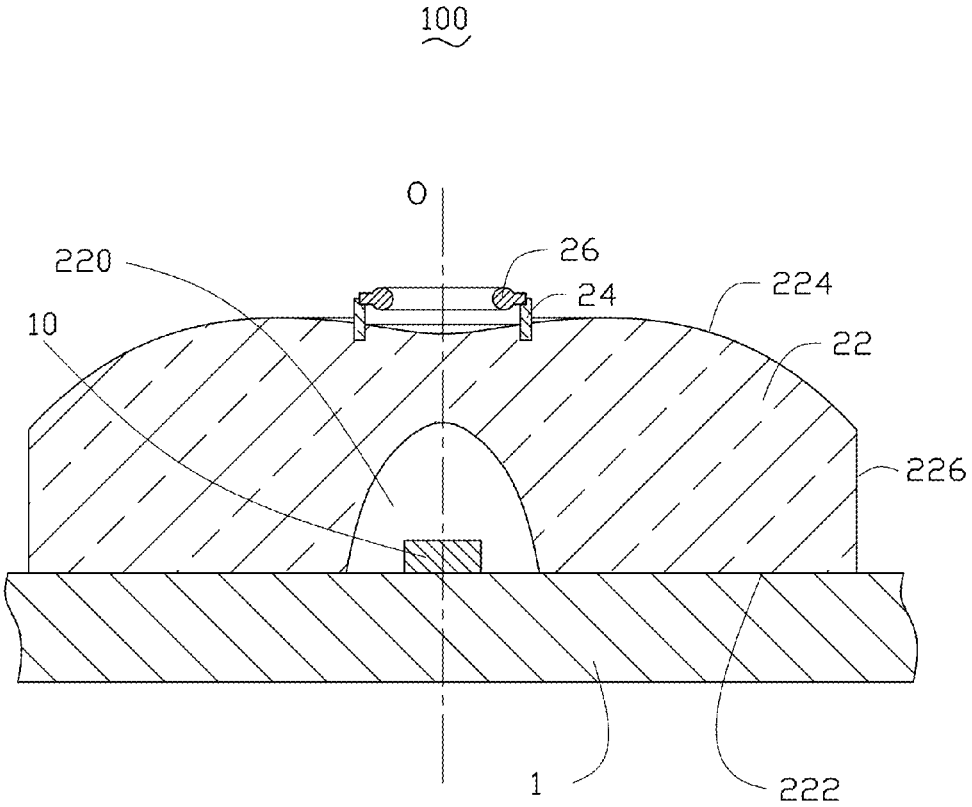
FIG. 4 is a cross-sectional view of the light-emitting device along line IV-IV in FIG. 2.

FIGS. 2-4 illustrate a light-emitting device 100. FIG. 2 is an isometric view of the light-emitting device 100. FIG. 3 is an exploded, isometric view of the light-emitting device 100 illustrated in FIG. 2. FIG. 4 is a cross-sectional view of the light-emitting device 100, along line IV-IV in FIG. 2.

As illustrated in FIG. 2, the light-emitting device 100 comprises a base 1, a light source 10 and a diverging unit 20. The light source 10 and the diverging unit 20 are placed on the base 1. The base 1 may be a substrate, a circuit board, or any other element prepared for mounting the light source 10 and the diverging unit 20. Light from the light source 10 is scattered by the diverging unit 20 to contribute to a uniform and even luminance. In the present embodiment, the light source 10 is an LED.

The diverging unit 20 includes a divergent lens 22, a conjugation part 24, and a diverging ring 26. The diverging ring 26 is assembled on the divergent lens 22 via the conjugation part 24.

As illustrated in FIG. 2 and further in FIGS. 3-4, the divergent lens 22 includes a light incident surface 222, a light exiting surface 224, and a side surface 226. The light incident surface 222 is abutting the base 1. The side surface 226 is coupled to the light incident surface 222 and the light exiting surface 224. The light exiting surface 224 is located furthest from the base 1. The light exiting surface 224 is an aspherical surface and has a smooth indentation on the top portion of the light exiting surface 224. The divergent lens 22 defines a receiving space 220 extending into the divergent lens 22 from the light incident surface 222 toward the light exiting surface 224. The divergent lens 22 has a central axis O. The light source 10 is placed on the base 1 and is received in the receiving space 220 in-line with the axis O. The divergent ring 22 further defines a ring-shaped recess 228 extending into the divergent lens 22 from the light exiting surface 224 toward the light incident surface 222. The ring-shaped recess 228 is symmetrical about the axis O.

The conjugation part 24 is circle and is configured to be inserted into the ring-shaped recess 228. The conjugation part 24 is partly exposed and projects from the ring-shaped recess 228 when inserted therein. The exposed outer portion of the conjugation part 24 has a plurality of mortises 249, which are located away from the divergent lens 22. The conjugation part 24 and the divergent lens 22 may be formed of the same material. In the present embodiment, the conjugation part 24 and the divergent lens 22 are made of polymethylmethacrylate (PMMA). The conjugation part 24 and the diverging ring 22 may be a single unit.

A cross section of the diverging ring 26 is round and the ring itself is a torus or donut-shape. The diverging ring 26 has an outer diameter which is less than an inner diameter of the conjugation part 24. The diverging ring 26 has a plurality of tenons 269 around an outer portion of the diverging ring 26. The tenons 269 are placed to correspond to the mortises 249 of the conjugation part 24. The diverging ring 26 is assembled to the conjugation part 24 by inserting the tenons 269 into the mortise 249. In that way, the diverging ring 26 is arranged on the light exiting surface 224 and in-line with the light source 10. Since the ring-shaped recess 228 is symmetrical about the axis O, the diverging ring 26 is symmetrical about the axis O. The outer surface of the diverging ring 26 is capable of reflecting light. In the present embodiment, the diverging ring 26 is placed a distance away from the light exiting surface 224. The distance between the diverging ring 26 and the light exiting surface 224 may be modified depending on the refractive index of light through the divergent lens 22. In the present embodiment, the diverging ring 26 is made of a PMMA base ring and a reflective coating is formed over the PMMA base ring. Another structure or material can be used to make the outer surface of the diverging ring 26 reflective.

Figure 5:
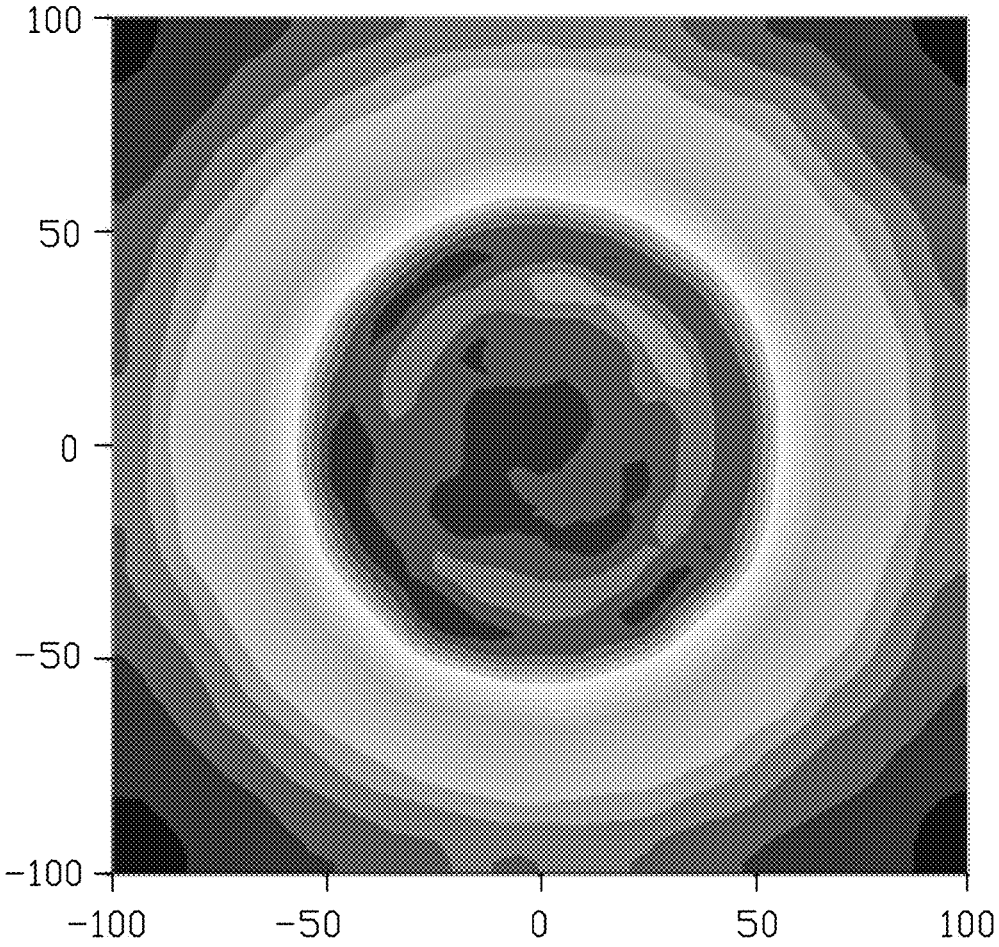
FIG. 5 illustrates a luminance simulation diagram of the light-emitting device illustrated in FIG. 2.

When the light-emitting device 100 is working, light from the light source 10 enters the divergent lens 22 from the light incident surface 222 and leaves the divergent lens 22 from the light exiting surface 224. The diverging ring 26 reflects light from the light source transmitted through the divergent lens 22 in multiple directions. So that the light-emitting device 100 provides light with uniform and even luminance. FIG. 5 illustrates a luminance simulation diagram of the light-emitting device 100 of the present embodiment. Comparing FIG. 1, which illustrates a luminance simulation diagram of a prior-art LED, the luminance provided by the light-emitting device 100 of the present embodiment is more evenly and uniformly distributed.

Figure 6:
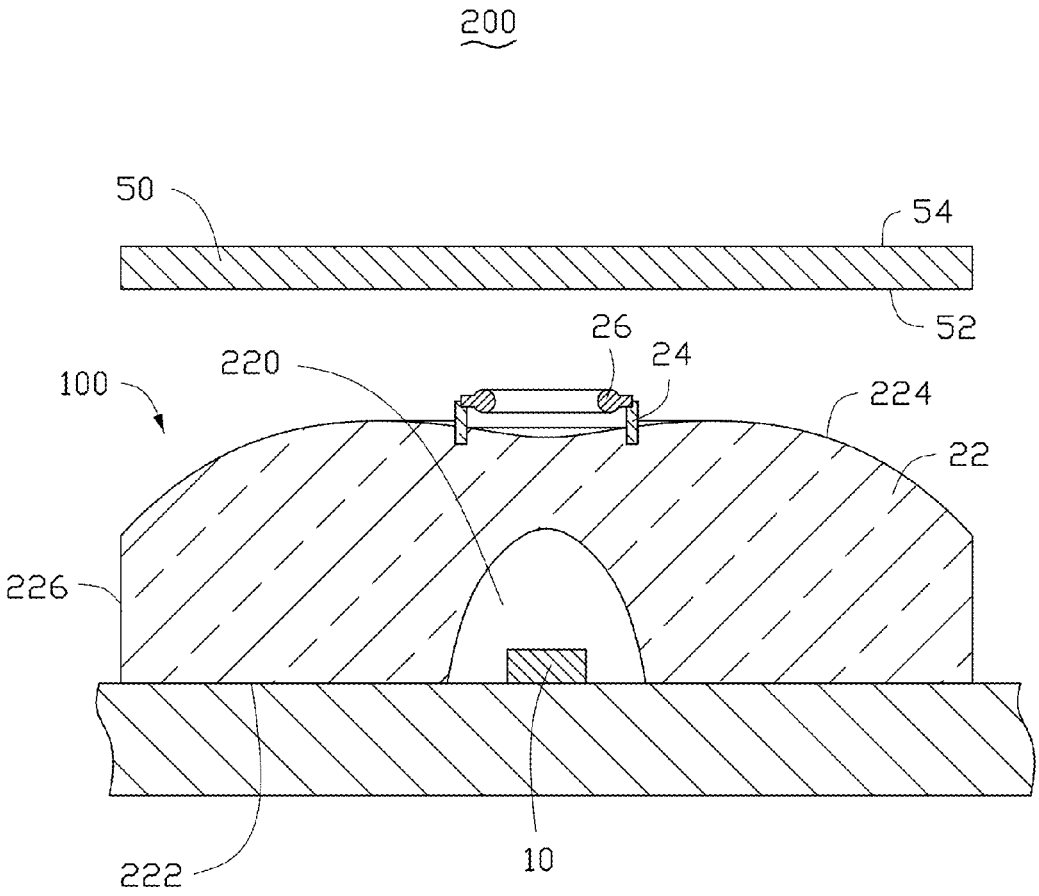
FIG. 6 is a cross-sectional view according to a second embodiment of a backlight module having the light-emitting device of the first embodiment and a diffusion plate therein.

FIG. 6 illustrates a second embodiment, illustrating a backlight module 200 having the light-emitting device 100 of the first embodiment and a diffusion plate 50 therein. The structure of the light-emitting device 100 is not here repeated.

The diffusion plate 50 includes an incident surface 52 on one side of the diffusion plate 50 and an exiting surface 54 located on the other side. The exiting surface 54 is on a side of the divergent lens 22 and located furthest from the light-emitting device 100. The incident surface 52 is parallel to the exiting surface 54. In other words, the incident surface 52 of the diffusion plate 50 is located on the side which is closest to the light exiting surface 224 of the light-emitting device 100 and faces the light exiting surface 224. Light coming from the light-emitting device 100 enters the diffusion plate 50 and is further scattered by the diffusion plate 50.

The embodiments shown and described above are only examples. Many details are often found in the art such as the other features of a light-emitting device. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, especially in matters of shape, size, and arrangement of the parts within the principles of the present disclosure, up to and including the full extent established by the broad general meaning of the terms used in the claims. It will therefore be appreciated that the embodiments described above may be modified within the scope of the claims.

What is claimed is:

1. A light-emitting device, comprising:

a base;

a light source positioned on the base; and a diverging unit positioned on the base and substantially covering the light source, the diverging unit comprising:

a divergent lens having a light incident surface abutting the base, a side surface coupled to the light incident surface and extending away from the base, and a light exiting surface, the light exiting surface furthest from the base; and a diverging ring positioned on the exiting surface of the divergent lens;

wherein, the divergent lens defines a receiving space extending into the divergent lens from the light incident surface toward the light exiting surface and the light source is received within the receiving space; and wherein, the diverging ring is positioned on the light exiting surface and in-line with the light source so that the diverging ring reflects light from the light source transmitted through the divergent lens in multiple directions.

2. The light-emitting device according to claim 1, wherein the light divergent lens further defines a ring-shaped recess extending into the divergent lens from the light exiting surface toward the light incident surface, the ring-shaped recess being symmetric about an axis of the divergent lens.

3. The light-emitting device according to claim 2, wherein the diverging ring is placed in the ring-shaped recess.

4. The light-emitting device according to claim 1, wherein the diverging ring has a cross section in circle along the axis of the divergent lens.

5. The light-emitting device according to claim 3, further comprising an conjugation part, wherein the conjugation part is circle and is inserted into the ring-shaped recess that a portion of the conjugation part is projected from the ring-shaped recess; the portion of the conjugation part has a plurality of mortises and the diverging ring has a plurality of tenons placed around the diverging ring that the tenons are inserted into the mortises to assemble the diverging ring to the conjugation part.

6. The light-emitting device according to claim 5, the divergent lens and the conjugation part comprises the same material.

7. The light-emitting device according to claim 1, wherein the divergent lens comprises polymethylmethacrylate (PMMA).

8. The light-emitting device according to claim 1, wherein the diverging ring comprises a base ring made of PMMA and a reflective coating over the base ring.

9. The light-emitting device according to claim 1, wherein the light source comprises a light emitting diode (LED).

10. A backlight module comprises:

a light-emitting device, comprising:

a light source positioned on a base; and a diverging unit positioned on the base and substantially covering the light source, the diverging unit comprising:

a divergent lens having a light incident surface abutting the base, a side surface coupled to the light incident surface and extending away from the base, and a light exiting surface, the light exiting surface furthest from the base; and a diverging ring positioned on the exiting surface of the divergent lens;

wherein, the divergent lens defines a receiving space extending into the divergent lens from the light incident surface toward the light exiting surface and the light source is received within the receiving space; and wherein, the diverging ring is positioned on the light exiting surface and in-line with the light source so that the diverging ring reflects light from the light source transmitted through the divergent lens in multiple directions;

a diffusion plate located on a side of the divergent lens opposite to the light source, wherein the diffusion plate and the divergent lens are aligned to transmit lights from the light source.

11. The backlight module according to claim 10, wherein the light divergent lens further defines a ring-shaped recess extending into the divergent lens from the light exiting surface toward the light incident surface, the ring-shaped recess being symmetric about an axis of the divergent lens.

12. The backlight module according to claim 11, wherein the diverging ring is placed in the ring-shaped recess.

13. The backlight module according to claim 11, wherein the diverging ring has a cross section in circle along the axis of the divergent lens.

14. The backlight module according to claim 13, further comprising an conjugation part, wherein the conjugation part is circle and is inserted into the ring-shaped recess that a portion of the conjugation part is projected from the ring-shaped recess; the portion of the conjugation part has a plurality of mortises and the diverging ring has a plurality of tenons placed around the diverging ring that the tenons are inserted into the mortises to assemble the diverging ring to the conjugation part.

15. The backlight module according to claim 14, the divergent lens and the conjugation part comprises the same material.

16. The backlight module according to claim 10, wherein the divergent lens comprises PMMA.

17. The backlight module according to claim 10, wherein the diverging ring comprises a base ring made of PMMA and a reflective coating over the base ring.

18. The backlight module according to claim 10, wherein the light source comprises an LED.

* * * * *